United States Patent [19]

Asher

[11] Patent Number: 4,484,362

[45] Date of Patent: Nov. 27, 1984

[54] MULTI-PURPOSE OUTERWEAR

[76] Inventor: Ron E. Asher, 1620 Dearborn Dr., Virginia Beach, Va. 23451

[21] Appl. No.: 152,027

[22] Filed: May 21, 1980

[51] Int. Cl.[3] ..... A41B 1/12

[52] U.S. Cl. ..... 2/69

[58] Field of Search ..... 2/69, 69.5, 88, 84

[56] References Cited

U.S. PATENT DOCUMENTS 2,237,368 4/1941 Seitzmn et al. ..... 2/91

3,161,887 12/1964 Silver ..... 2/88

FOREIGN PATENT DOCUMENTS 885238 12/1961 United Kingdom ..... 2/88

*Primary Examiner*—Doris L. Troutman

*Attorney, Agent, or Firm*—William F. Frank

[57] ABSTRACT

The present invention comprises a substantially rectilinear sheet of waterproof pliable material. Each of the longer sides of the panel carries an element of a partable zipper employing a double slide. Each zipper element is inset from the respective edge so as to provide a flap along each edge on which flaps are cooperating and mating closures, such as snaps or Velcro-type material. Across each shorter end of the panel is a tube of the same or attached material each of which contains a draw cord which preferably is of an elastic nature. Snaps or Velcro-type material may be provided on both sides of each tube to permit joining two or more sheets. A head opening is provided in the center of the panel. A hood element is secured to the head opening and has a sleeve containing a draw cord for purposes of closure of the hood about the head of the wearer. Utilizing the zipper elements and the drawstrings in various combinations, the panel may be used as a conventional style poncho or as a full length hanging garment having a cape over a backpack or a short length garment with the cape over a backpack or as a complete enclosure when sitting or as a sleeping bag, a tent or a hammock. Loops may be provided along each longer side so the sheet may be used as a stretcher or to carry large objects.

2 Claims, 10 Drawing Figures

MULTI-PURPOSE OUTERWEAR

FIELD OF THE INVENTION

The present invention relates to the field of outdoor activity such as camping, hiking, hunting, fishing and the like and to outerwear and accoutrements associated therewith. More particularly, the invention relates to a single piece of outerwear which will provide full weather protection when a person is standing, sitting or reclining.

BACKGROUND OF THE INVENTION

The present poncho types are not functional for uses such as a storm-proof sleeping shelter, sleeping bag, hammock or as a fitted outerwear garment for example to cover the upper body as an anorak or to cover the full body as a cagoule, both the latter type garments being commonly used by mountaineers. Currently, persons that want the above combination of useful items are required to carry them as separate units.

U.S. Pat. Nos. 3,958,274; 1,193,443 and 650,074 disclose the general state of the art on the above poncho types.

The disadvantages of carrying separate equipment such as an anorak, cagoule, hammock, sleeping bag, sleeping shelter are very obvious to campers and mountaineers and there is an obvious need to reduce not only the number of items but their weight and bulk.

SUMMARY OF THE INVENTION

The present invention provides an item of outerwear which can be adapted to provide complete weather protection while walking or riding in the open, sitting or reclining. The present invention will serve as a marginal lean-to or as a hammock and can adopt various other useful configurations when combined with accessories.

The present invention provides a single piece of outerwear which can be adapted to provide stormproof sleeping protection or fitted outerwear.

The invention also provides for two or more to be joined together for larger shelters.

One adaptation of the invention provides a cape to cover a backpack when worn in an anorak or cagoule-like mode.

The present invention also provides a single item of outwear which is light-weight and which can quickly and easily be transformed from one use to another.

Another adaption of the invention provides for it to be used as a two-point suspension hammock.

When the present invention is combined with certain and various accessories such as; mosquito netting, solar panel, integral expanded suspension, snap and fastening systems and insulative and reflective linings, etc., the utility derived from such combinations will be limited only by the imagination of the wearer.

BRIEF DESCRIPTION OF DRAWINGS

The novel features of construction, composition, arrangement of parts, and utilization of the invention will become more readily apparent from an examination of the following specifications taken with the accompanying illustrative drawings wherein.

DETAILED DESCRIPTION OF THE INVENTION

Figure 1:
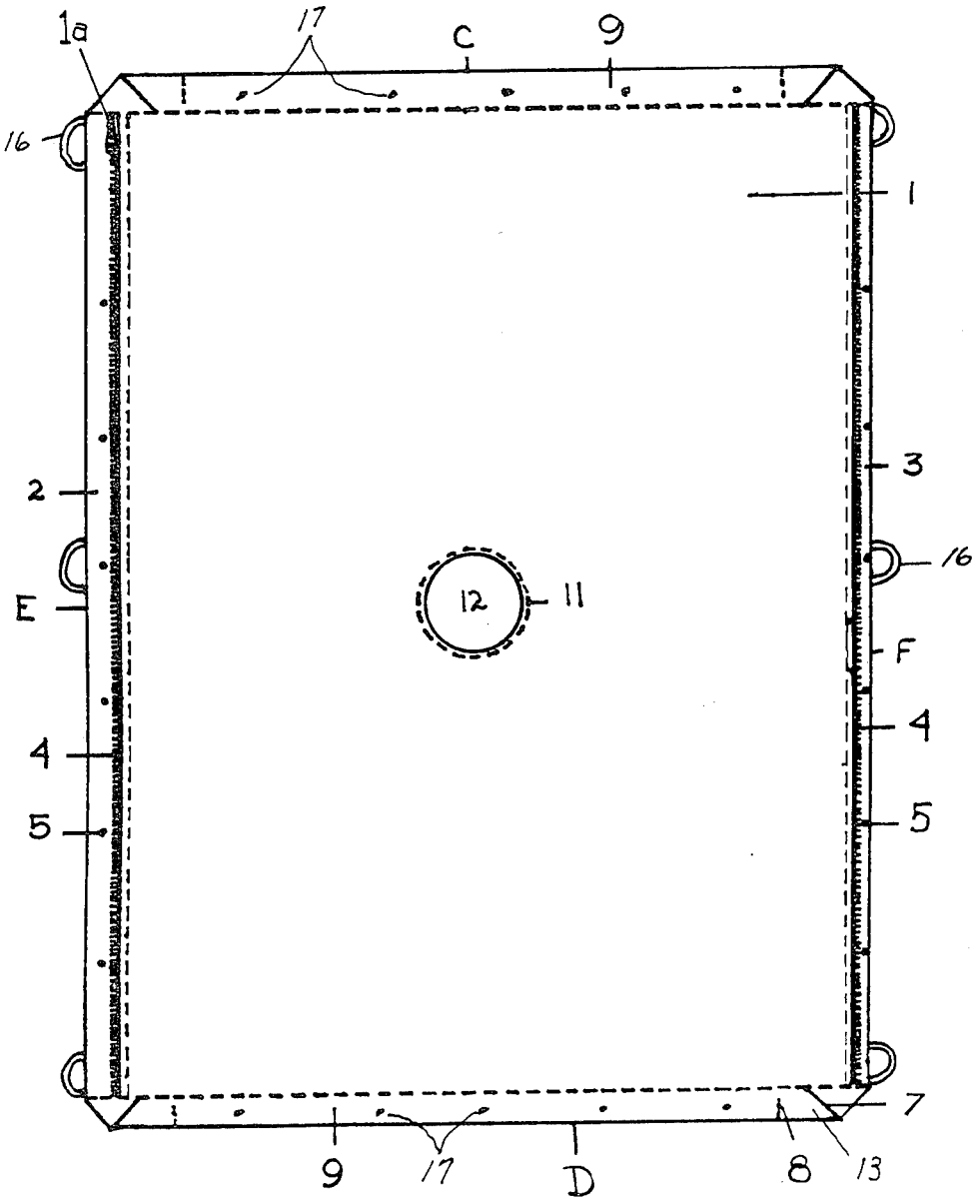
FIG. 1 is a plan view of the inner side of one embodiment of the invention.

Illustrative of the embodiment shown by FIGS. 1-9, and preferred, the present invention comprises a substantially rectangular main sheet 1 of material which is pliable even at low temperatures and waterproof, such as urethane-coated nylon. A material known by the trade name of Gore-Tex is most usable also. The sheet may also be composed of a central section of Gore-Tex with each end section being of the waterproof material. The sheet with a length of 7 feet and width of 6 feet has been found generally suitable for the average person. Size may vary with the user and the type of fit desired. The main sheet 1 is provided with sewn or welded flaps 2, 3 on the longer sides E and F. Interiorly of said flaps on each side is an element of a fastening device, the preferred being a separating zipper 4 employing a double slider 4*a* and secured to sheet 1 by seam 10. When the zipper is closed, small flap 3 lays over the closed zipper while the larger flap 2 lays over smaller flap 3.

Figure 10:
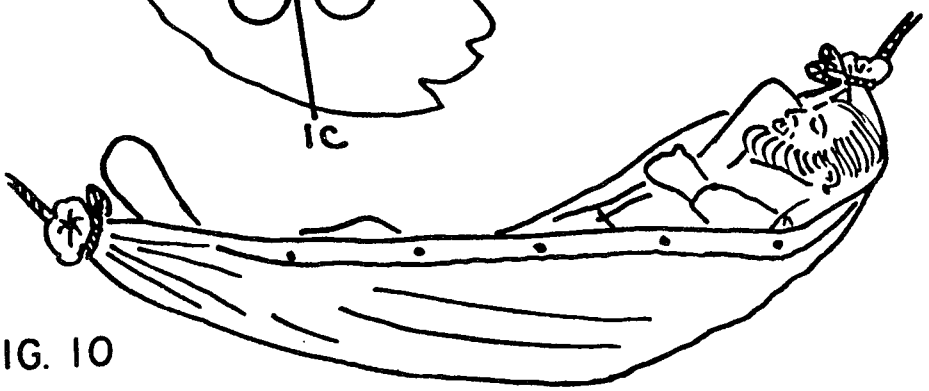
FIG. 10 is a view of the invention employed as a hammock.

The invention as described relative to FIG. 1 can be utilized to form a hammock as in FIG. 10. In this instance the zippers 4 are joined together to form a sheet into a panel having the same length as the sheet shown in FIG. 1 but of only half the width. The cords A in sleeves 9 and C and D are then drawn out of the sleeve so as to compress each end C and D into a knot-like configuration. The cords are then wrapped around the knot to retain it in that configuration. Selectively the snaps 5 on each longer side may be joined together. The thus formed narrow elongated panel with its knot-like configurations on each end is then attached around each configuration to a line which in turn is suspended from any vertical support to form the hammock.

Cooperating snaps 5 spaced along flaps 2 and 3 provide closure when the flaps are aligned over the zipper 4. Closure of flaps 2 and 3 may be with a product known by the trade name of Velcro or like fastening devices. Loops 16 may be provided on flaps 2 and 3 so the sheet may be used as an emergency stretcher.

Each of the shorter sides C and D of main sheet 1 terminates in a sleeve or tube 9 which is formed from the material of main sheet 1 by seam 6. Each sleeve 9 contains a draw cord or belt-like line A whose ends are inside a pocket 13 created by seam 8 and fold 7. When both ends of the cord are pulled, the length of sleeve 9 can be greatly compressed. Rings, tabs, or grommets may be substituted for the sleeve and the pocket omitted. Snaps 17 may be provided on the shorter sides so two or more can be joined together along these sides.

Figure 9:
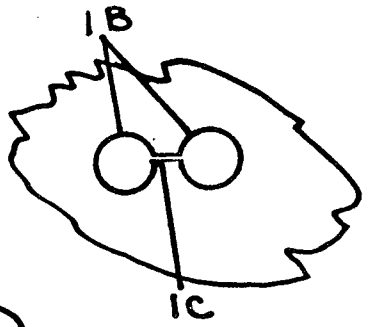
FIG. 9 is a plan view of the center portion of the main sheet 1 showing another embodiment of the head opening.

Centrally located on the sheet 1 is a head opening 1*a*, shown in FIG. 1 as a single curvilinear form. As seen in FIG. 9 the head opening may also comprise a pair of spaced curvilinear openings 1*b* interconnected by a slit 1*c*. Attached to the head opening by a seam 11 is an additional sheet of the material formed into a hood 12. The hood 12 also contains a drawstring G and may contain one or more pairs of opposing snaps. 5. A hood 12 covers the head and can be drawn around the face with the draw cord G. Other devices to restrict the opening of the hood may be employed. The hood may be omitted and a drawcord arrangement provided around the head opening.

Figure 2:
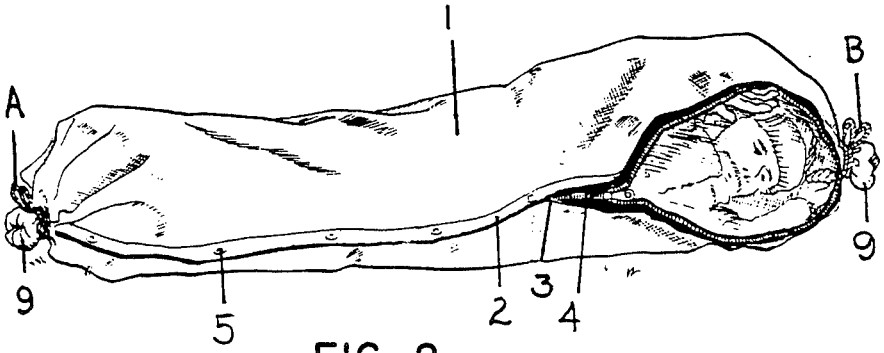
FIG. 2 illustrates the use of the invention as a stormproof sleeping bag.

FIG. 2 shows use of the invention as a weather-proof cover for sleeping or reclining made possible by the novel application of fastening devices. The zipper 4 is closed and is covered by flaps 2, 3 which are secured by snaps or fasteners 5. Sleeves 9 are compressed by pulling cords A from their respective sleeves. Draw cords A are wrapped tightly around the compressed sleeves and secured by a suitable tie such as the clasp J in FIG. 6 thus achieving a stormproof closure of sides C, D FIG. 1.

Figure 3:
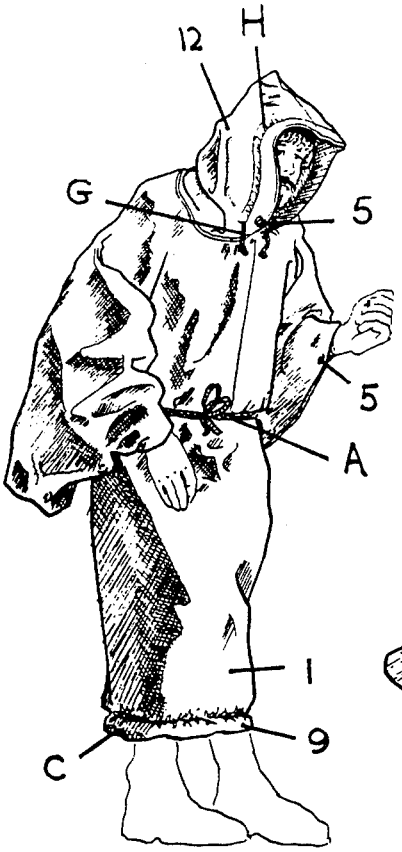
FIG. 3 depicts a parka or cagoule-like configuration of the invention.
Figure 6:
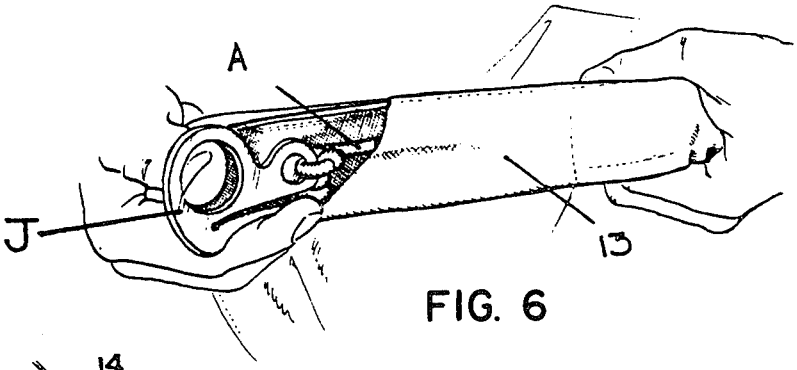
FIG. 6 is a view of a feature useful for closing the ends of the invention.

FIG. 3 shows the sheet in an embodiment with a cagoule-like appearance and serving the purposes and uses of same. Hood 12 is shown enclosing the head excepting an opening at the face. The opening is secured by a fastener 5 with or without a gussett, a snap being preferred and drawn snug, if necessary, by the cord G contained by sleeve H, to close the head opening completely as in FIG. 2, to the inside or outside of sheet 1. Fastening device 5, the preferred being snaps, create sleeves for each arm, the fasteners being positioned to allow the fabric to be held around the wrists of wearer and further join to enclose a sleeve extending toward the body from the wrists. As described thus far the invention resembles the currently well-known poncho type outerwear. Complete formation of the cagoule-like garment and as depicted in FIG. 3, the zipper element is closed from the end C by one of the sliders to about the waist of the wearer. This closure would be approximately one-third the total length of the zipper element but will vary with the height of the wearer. Thus the lower portion of the sheet 1 is now formed into a skirt-like configuration. This leaves the remaining portion of sheet 1 which would include side D free and unfettered in a cape-like configuration which would conveniently cover a backpack. The draw cord A in sleeve 9 of side C is then pulled tight around the waist as shown in FIG. 3 and ends of the cord are secured as desired either by tying or by utilizing the clasps J as shown in FIG. 6. If greater freedom for leg movement is desired in the lower portion of the configured garment, the remaining slider may then be open to the extent required.

Figure 4:
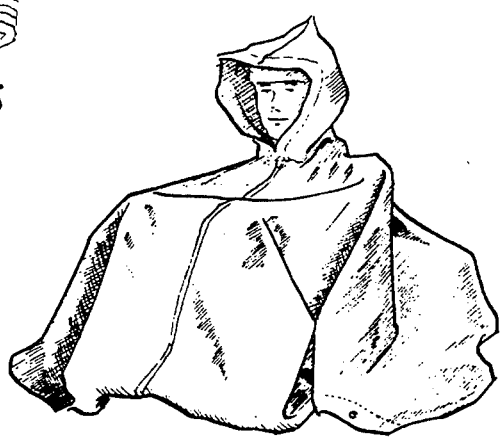
FIG. 4 is a showing of the invention used for a sitting shelter.
Figure 5:
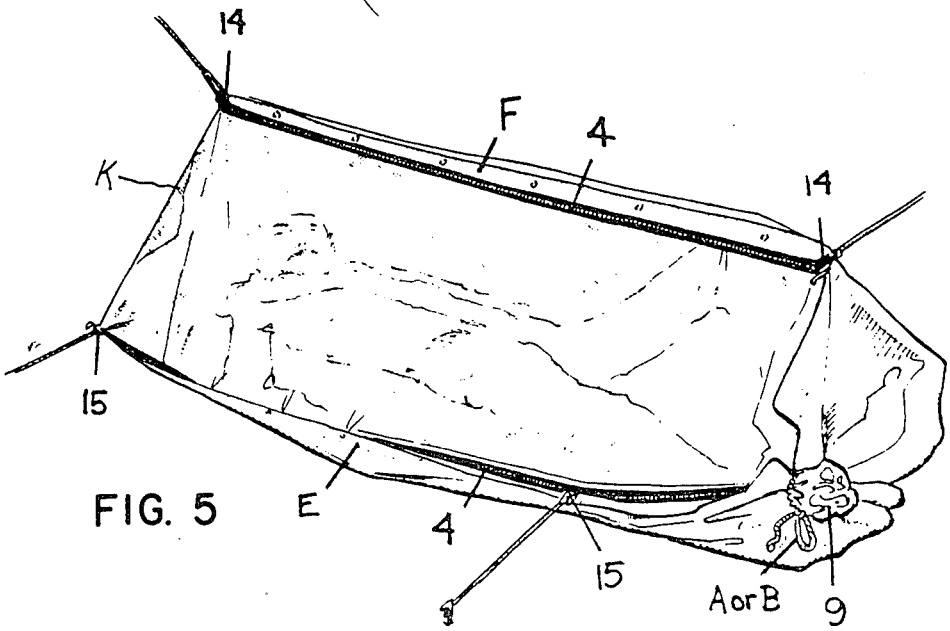
FIG. 5 illustrates the use of the invention and a mosquito netting panel to form a shelter.

The use of the present invention to form a weather-proof embodiment for sitting as shown in FIG. 4 is accomplished by untying the cord A as described for the forming the cagoule-like embodiment and sitting down. The tent-like shelter shown in FIG. 5 is formed by attaching a netting panel K to the zippers along sides E and F of sheet 1. The unattached opposing edges of panel K are then contained within sides C and D respectively by using the draw cords to compress the sleeves 9 on each of side C and D. Flaps E and F may contain tapes or gromments 14 in FIG. 5 to which may be attached lines 15 which serve the purpose as illustrated thereto to hold side F up as a peak of a tent or lean-to shelter and to pull side E out to provide a floor-like element. In this embodiment the head opening 1*a* is closed by pulling the drawstring G tightly with the hood 12 either inside or outside the sheet 1 and tying it.

FIG. 6 shows the details of the pocket 13 formed in each sleeve 9 and the draw cord A and illustrated type clasp J which is produced by the ISI Manufacturing Company. The clasp is not required as the ends of the cord A could be suitably knotted together. The cord A may be of an elastic or non-elastic character.

Figure 7:
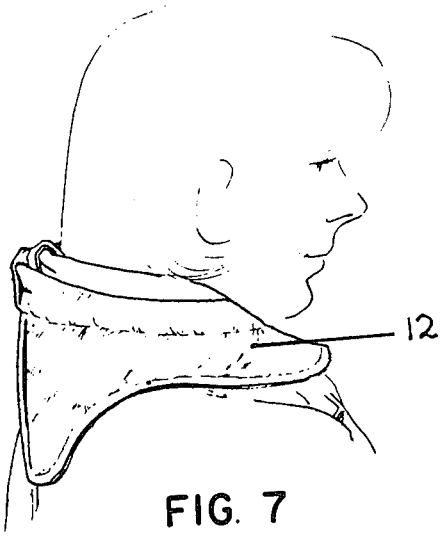
FIG. 7 is a view of an embodiment of the hood bill used to form a collar.

In FIG. 7 the hood 12 has been turned inside out so that the top of the hood which normally would form a bill-like projection is turned wrong side out so as to settle the hood neatly over the shoulders to form a collar. The collar can be drawn up snugly around the neck by the draw cord G.

Figure 8:
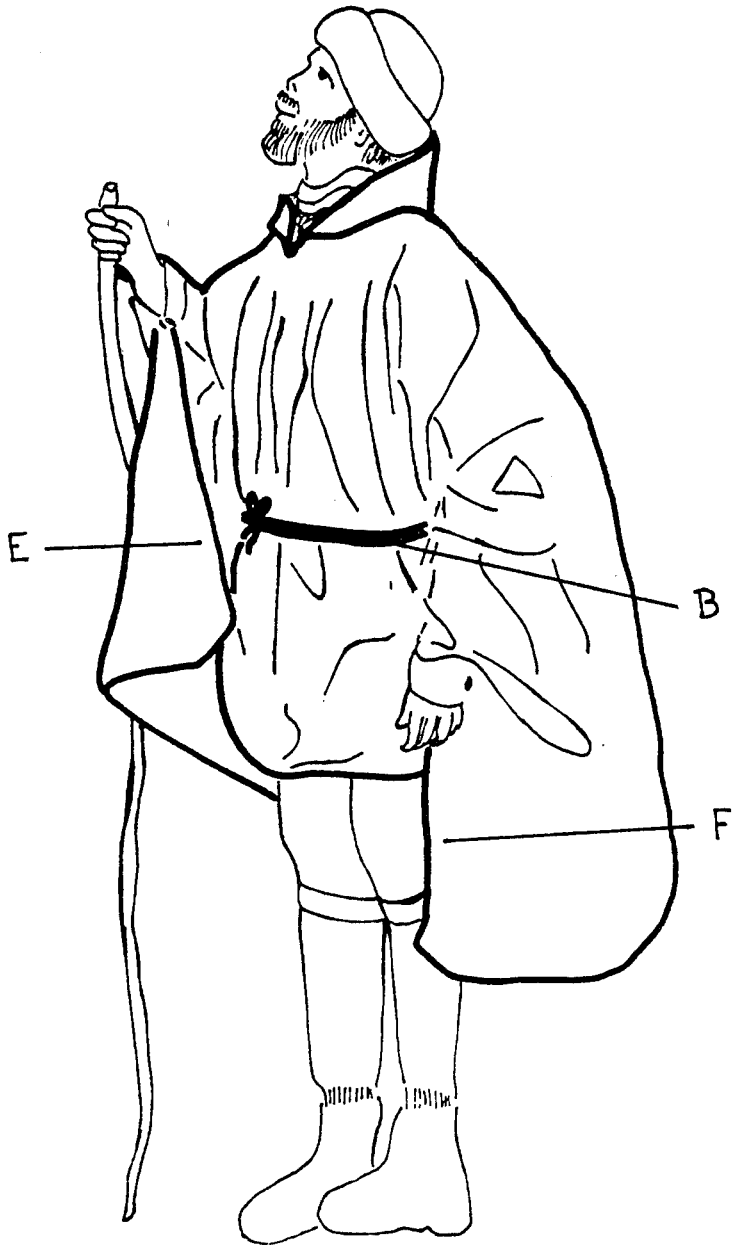
FIG. 8 is a view of the invention employed as a cape in an anorak-like configuration.

The configuration of the invention as shown in FIG. 8 is achieved by first forming the poncho-type configuration as described in the first portion of the paragraph relating to FIG. 3. In lieu of pulling the draw cord A inside D to the waist as described for FIG. 3, the zipper elements are not closed as described for FIG. 3 but are left separated. Side C is raised to the waist and draw cord A in sleeve 9 of side C is drawn so as to carry side C around the waist toward the back and the ends of the cord are then crossed, brought to the front and secured to one another. In this instance side D then becomes a full cape.

The embodiment of the present invention as described and shown in the drawings shows a preferred use of zippers and snaps. Such closure type devices known as VELCRO, a registered trademark, may be utilized in their place. However, it has been found that under certain conditions, particularly when working in brushy terrain the VELCRO tends to collect twigs and leaf fragments and the like which greatly impair its usefulness.

The sheet 1 may be trapezoidal with one shorter side of less length than the opposite shorter side. Also, one shorter side in the rectangular configuration may have a triangular extension.

The embodiments shown and described herein are by way of illustration only and in no way limiting the present invention. Changes may be made in composition and arrangement of the parts illustrated by those of skill and experience in the particular field to which the invention relates without departing from the scope of the invention as set forth in the appended claims.

I claim:

1. A multi-purpose outerwear garment comprising a rectangular sheet of waterproof pliable material having a centrally positioned head opening therein; hood means including a draw cord attached around said head opening, said draw cord serving to selectively completely close said opening; zipper means positioned along the edge portion of each of the longer sides of said sheet which co-operate with each other to interconnect said longer sides to a predetermined length, said zipper means being spaced inwardly from the outer edge of said edge portions to form a flap between said zipper means and said edge on each longer side; means on each shorter side of said sheet for compressively decreasing the length of said shorter side selectively, said compressively decreasing means comprising a cord-like element slidably positioned in a sleeve positioned along each said shorter side edge; a first plurality of snap-like means spacedly positioned along each of said flaps to interconnect, in a selective manner, said flaps when said zippers are joined together to form a weather cover for said zippers or to interconnect a longer side of said sheet with a longer side of another sheet; and a second plurality of snap-like means positioned along each said sleeve to selectively connect each shorter side to itself when said sheet is folded along the longer axis or to interconnect a shorter side of said sheet with a shorter side of at least one additional said sheet.

2. A multi-purpose outerwear garment comprising a rectangular sheet of waterproof pliable material having a head opening centrally located therein, first fastening means along each longer side of said sheet to cooperate with each other to secure each longer side to the other over a selectable length, second fastening means along each longer side of said sheet to cooperate with each other to attach one of said longer sides to the other to form a weatherguard for said first fastening means or to selectively attach a longer side of said sheet to a longer side of at least an additional sheet, third fastening means along each shorter side of said sheet to selectively connect each shorter side of said sheet to itself or to a shorter side of at least one additional sheet, loops along each edge of said longer sides to receive poles when using the garment as a stretcher, means comprising a cord-like element in a sleeve on each of said shorter sides for compressively decreasing the length of said shorter side selectively and a hood element secured to said head opening, the hood element have draw cord means for closing a face opening in said hood element about the face of a wearer and for selective closing of said head opening by pulling said draw cord means tightly to close the face opening and then tieing the draw cord means about the hood element.

* * * * *